United States Patent [19]

Yamana et al.

[11] Patent Number: 4,619,513

[45] Date of Patent: Oct. 28, 1986

[54] ELECTROPHOTOGRAPHIC SYSTEM

[75] Inventors: Keiichi Yamana; Hajime Tachibana; Shuichi Ohtsuka, all of Kanagawa, Japan

[73] Assignee: Fuji Photo Film Co., Ltd., Kanagawa, Japan

[21] Appl. No.: 589,355

[22] Filed: Mar. 14, 1984

[30] Foreign Application Priority Data

Mar. 18, 1983 [JP] Japan ..... 58-44324

[51] Int. Cl.[4] ..... G03G 15/02; H01T 19/04

[52] U.S. Cl. ..... 355/3 CH; 250/324; 355/14 CH; 361/235

[58] Field of Search ..... 355/3 BE, 3 CH, 13, 355/14 CH; 250/324, 325, 326; 361/235

[56] References Cited

U.S. PATENT DOCUMENTS

| | | | |
|---|---|---|---|
| 3,303,401 | 2/1967 | Naumann et al. | 250/324 X |
| 3,554,161 | 1/1971 | Blanchette | 250/325 X |
| 3,653,757 | 4/1972 | Newcomb | 355/13 |
| 3,996,466 | 12/1976 | Davis | 250/325 |

*Primary Examiner*—Fred L. Braun

[57] ABSTRACT

An electrophotographic device for a magnetic brush development process in which a conductive material is used for rollers in the conveying mechanism of electrophotosensitive materials which abut on the materials after a charging step by a charging device, but before a developing step by a developing device so as to insulate the rollers from other components. One portion of a shield case of the charging device is insulated from another portion and is electrically connected to the rollers, thereby applying a bias voltage on the rollers using the voltage induced on this portion due to high voltage applied on a corona wire of the charging device.

8 Claims, 6 Drawing Figures

ELECTROPHOTOGRAPHIC SYSTEM

BACKGROUND OF THE INVENTION

This invention relates to an electrophotographic system that is suitable for a magnetic brush development process which hitherto posed a problem as the roller conveying electrophotosensitive material often spoils the material when it abuts thereon after the charging step but before the developing step.

As a typical example shows in FIG. 1, an electrophotographic system provides a process comprising the following steps: rolling out a roll of electrophotographic material member 1 having an electrophotosensitive surface 1*a* of a photoconductive insulating layer as the electrostatic latent image-bearing member into a sheet and uniformly applying an electrostatic charge on the member by an electric charging device 2; exposing the member to light by an exposure device 3 to leave an electrostatic charge in a pattern corresponding to the original images and thereby to form electrostatic latent images on an electrophotosensitive surface 1*a;* depositing a toner onto said electrophotosensitive surface 1*a* by a development device 4 so that the toner may be selectively adhered thereto in a pattern corresponding to the original images to form picture images; and fixing the toner by a fixing device 5.

A vast majority of such developing processes utilize the two-component magnetic brush method as the developing process with a development device 4. In this method, the two-component developing agent or the toner contains carrier beads on the surfaces of which a large number of toner particles is adhered. The toner is cascaded over the area where the electrostatic latent images are formed or the other area where non-latent images are formed so as to make only toner particles adhere to the latent image area (positive images) or to the non-latent image area (reversed images). More particularly, carrier beads and toner particles are applied with electrostatic charges of opposite polarity so that the toner particles adhere onto the carrier beads. As shown in FIG. 1, the two-component developer mixture thus prepared adheres to a non-magnetic sleeve 4*b* which rotates around a permanent magnet 4*a* so that the toner is conveyed close to the electrophotosensitive surface 1*a* by the rotation of the permanent magnet 4*a* or the sleeve 4*b*. As said carrier beads either include ferromagnetic beads or present ferromagnetism as a whole, said permanent magnet 4*a* can form a magnetic brush of the two-component developer near the electrophotosensitive surface 1*a*. The magnetic brush slidingly contacts the electrophotosensitive surface 1*a* as the magnet 4*a* or the sleeve 4*b* rotates, thereby making the toner particles adhere to the electrophotosensitive surface 1*a* or more specifically selectively to either the latent image area or the non-latent image area. Another technique widely used for development is a liquid development process. A pigment such as carbon black is dispersed in an insulating liquid to prepare the liquid developer or the toner. The pigment as a colorant in the liquid toner is electrically charged either positive or negative, the polarity of which depends on the type and amount of chemical component in the toner. The development process is conducted by electrostatic force on either the positive or negative charge. More particularly, when the pigment is applied to the electrophotosensitive surface formed with electrostatic latent images, the pigment is selectively adhered in the pattern corresponding to the latent images to form picture images.

In the development process of the two-component magnetic brush technique or the liquid developer method mentioned above, whether the toner particles are adhered to the latent image area to effect positive development or to the non-latent image area to effect negative development is determined absolutely by the combination of the polarity of the toner particles and the charged polarity of the electrophotosensitive surface. That is, when the surface is charged negative, if the toner particles are positive in polarity, the images become positive. In order to produce negative or reversed images, a toner which makes the toner particles negative should be selected. Alternatively, if toner particles of positive polarity are used, an electrophotosensitive surface charged positive should be used. Both the component magnetic brush method and the liquid development method lack flexibility in selection between positive or reversed images.

In order to obviate the aforementioned problems, there has recently been proposed another development method called the one-component magnetic brush process. (See, for example, U.S. Pat. No. 3,909,258). This method uses toner particles alone without ferromagnetic carrier beads. Conductive toner particles including ferromagnetic material are adhered to a conductive sleeve 4*b* which is internally provided with a permanent magnet 4*a,* and conveyed close to an electrophotosensitive surface 1*a* to form a magnetic brush comprising said toner particles alone. If said sleeve 4*b* is grounded, as a conductive path or a magnetic brush is formed between the toner particles and the sleeve 4*b,* an electric charge of the polarity opposite the electric field on the surface 1*a* is induced on the toner brush.

As a result, when the electric force of said electric charge exceeds the counteracting magnetic force generated by the permanent magnet 4*a,* the toner particles adhere to the electrophotosensitive surface 1*a.* The toner is thus adhered to the latent image area to form positive images. On the other hand, if said sleeve 4*b* is applied with bias voltage of substantially the same electric potential as the surface 1*a,* the toner brush becomes substantially the same electric potential with the latent images on the surface 1*a.* Said electric force rarely occurs here with toner particles and the toner is adhered by an electric force greater than the said magnetic force which acts with the non-latent image area. In this case, therefore, the toner is adhered to the non-latent image area to develop reversed images.

The one-component magnetic brush development process is suitable for devices such as a reader/printer which requires both positive and reversed development images, as either positive or negative images can be selected simply by grounding the sleeve 4*b* or by applying bias voltage thereon.

As shown in FIG. 2, in the one-component magnetic brush development process, when the electric charge on the latent image area disappears slightly for some reason, identations 6*a* are formed in the electric potential pattern. The recessed portion will cause a density fluctuation in positive images and it also will cause a fogging phenomenon that will blacken a portion which should be developed white. In the two-component magnetic brush development process, the ill-effect caused by the indentations 6*a* may be removed by applying an appropriate bias voltage on the sleeve 4*b* such as an electric potential between a latent image area 6 and a non-latent image area 7. In the one-component magnetic brush process, however, such ill-effect cannot be removed simply by such bias voltage. A bias voltage of electric potential substantially the same as the latent image area 6 is generally applied in the process. Whether it is higher or lower than the above potential, this causes an inclination in the electric potential between the electrophotosensitive surface 1*a* and the toner particles and when the thus-generated electric force on the toner particles is greater than the magnetic force of the permanent magnet 4*a*, the toner particles will be adhered. In other words, the stage of the electric potential pattern of the surface 1*a* is the decisive factor in determining the quality of development in the one-component magnetic brush process.

There are various reasons for causing such indentations 6*a*. Experiments conducted by the inventors reveal that an important factor lies in the rollers which abut on the surface 1*a* after the electric charge step but before the development step in the conveying mechanism of electrophotographic materials. More particularly, as shown in FIG. 1, this type of electrophotographic device comprises a pair of rollers 8, 8*a* which pull out a roll of an electrophotographic member 1, a cutter 15 which severs the roll of electrophotographic member 1 to the length optimal for recording data by one picture image, a roller 11 which changes the direction of the member by 90° after having been charged by the charging device 2, and conveys the electrophotographic member 1 to the exposure device 3 in cooperation with a belt 10 suspended on rollers 9, 9*a*, a pair of rollers 12, 12*a* which convey the member 1 to the developer 4 after exposure to light, a roller 13 which supports the member 1 from underneath the sleeve 4*b* of the developer 4, a pair of rollers 14, 14*a*, and a backup roller 14*b* at the fixing device 5 which conducts pressurized fixing. Among those rollers, if rollers 11, 12 which abut on the surface after charging and before development are made of insulating material, when these rollers 11, 12 are soiled or stained with powder from the conductive layer or the substrate of the electrophotographic member 1 or the toner particles, it will cause fluctuation in density (in the case of positive development) or fogging (in the case of reversed development). This is because the stains on the rollers 11, 12 will non-uniformly attenuate electric charges on the surface 1*a* in contact with the rollers, as vinyl chloride, ABS, phenol resin, etc. are usually utilized as insulating materials. On the other hand, if the rollers 11, 12 are made of metal and electrically connected to a frame of the body via bearings, the rollers will have the same potential as the body frame. Electric discharge will occur between the surfaces of the rollers 11, 12, and the surface 1*a* will thus reduce the density on the developed surface (in the case of positive images) or will cause fogging (reversed images).

SUMMARY OF THE INVENTION

This invention, in view of the problematic aspects encountered in the conventional technology, aims at providing an electrophotographic device which is capable of developing a high fidelity surface free of density fluctuation or fogging in the one-component magnetic brush process by employing a novel structure of a roller which abuts on the electrophotosensitive surface after the electric charging step but before the development step. In order to achieve such objects, the technical philosophy of this invention lies in that the rollers which abut on the electrophotosensitive surface after the charging step but before the development step are formed with conductive material, are insulated from other components so as to become electrically floating rollers and are applied with bias voltage using an electric voltage generated on a shield case of a charging device.

DETAILED DESCRIPTION OF THE PREFERRED EMBODIMENTS

Figure 1:
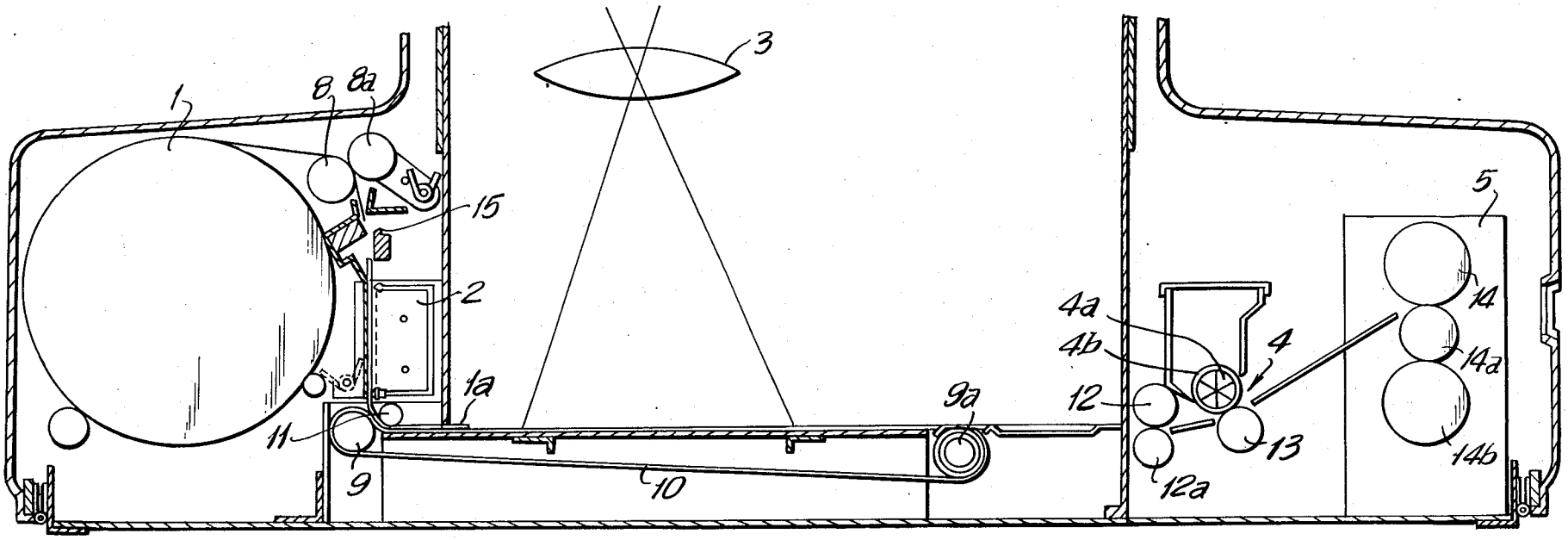
FIG. 1 is a schematic view to depict the structure of an electrophotographic device.
Figure 2:
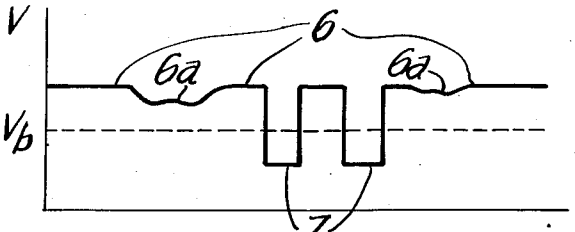
FIG. 2 is an explanatory view to show the electric potential pattern of an electrophotosensitive member thereof.

This invention will now be explained in more detail referring to the attached drawings. In embodiments of this invention, rollers 11, 12 shown in FIG. 1 or the rollers which abut on the electrophotosensitive surface after the electric charging step of the surface 1*a* but before the development step are made of conductive material such as metal, metal oxide, carbon, metal deposited on resin surface, resin containing metallic powder, conductive rubber, etc. and are made into floating rollers which are electrically insulated from other parts. A belt 10 which opposes the roller 11 via an electrophotosensitive member 1 is required to be made of an insulating member or to have a structure wherein the roller 11 and the belt 10 may be electrically insulated by the electrophotosensitive member 1 when the member 1 is being passed through between the said roller 11 and the said belt 10. Otherwise, the roller 11 which contacts the surface 1*a* of the electrophotosensitive member 1 is electrically connected to the conductive layer or the bottom layer of the member 1 via the belt 10 and the roller 11 becomes of the same potential as the conductive layer to cause discharge between the roller 11 and charged surface 1*a*. A similar phenomenon occurs between rollers 12, 12*a* and the member 1. The roller 12*a* therefore needs to be formed with an insulating member or to have a structure wherein the rollers 12, 12*a* can be electrically insulated by the member 1 while the member 1 is being passed through between the rollers 12, 12*a*.

Figure 3:
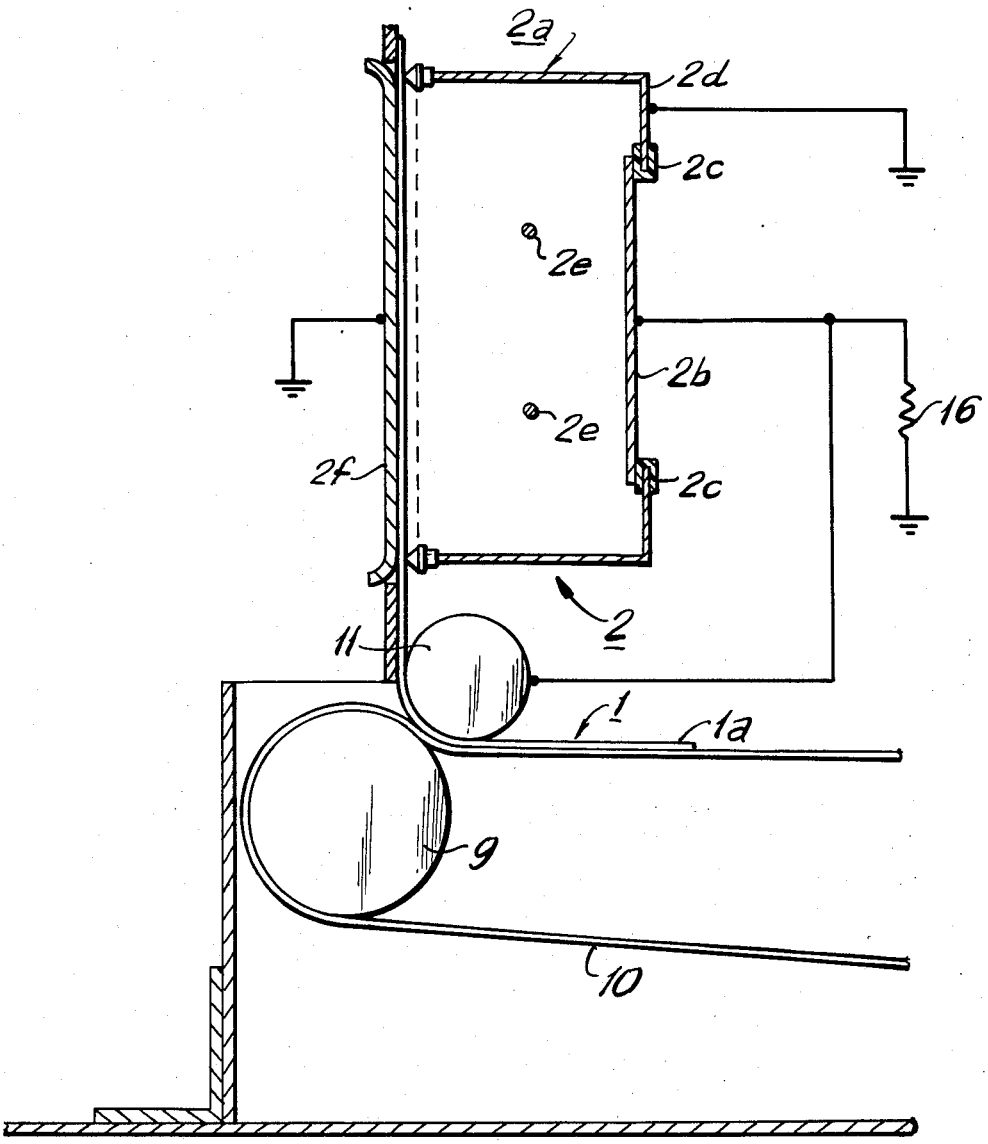
FIG. 3 is a vertical cross section to show the main parts of a first embodiment of this invention.

FIG. 3 shows critical parts in the first embodiment, mainly a charging device 2 and a roller 11 which was shown in FIG. 1. A portion 2*b* of the shield case 2*a* of the charging device 2 is insulated by insulating members 2*c* from a portion 2*d*. The portion 2*b* is electrically connected to said roller 11 and is grounded via a resistor 16. When high electric voltage is applied to corona wires 2*e* of the charging device 2, the electrophotosensitive surface 1*a* of the member 1 is charged due to corona discharge and at the same time an electric voltage occurs on the portion 2*b* of the shield case 2*a*, thereby applying bias voltage on the roller 11.

The embodiment is conceived based upon the following observation. Aesthetically satisfactory surfaces may be developed when the roller 11 is made of such a conductive material so as to become a floating roller insulated from other parts and said roller 11 is suitably applied with bias voltage. However, this method requires a power source for bias voltage, which makes the device complex in structure. Experiments reveal that the optimal bias value varies depending on environmental conditions or the difference by lots of the member 1. In other words, when zinc oxide coated paper which is charged to saturation is used as the electrophotosensitive member 1, the zinc oxide coated film forming the electrophotosensitive surface 1*a* fluctuates microscopically in a charged state although the surface roughly has uniformity in charged electric potential if viewed macroscopically. With excessive bias voltage, electricity is discharged from the roller 11 to the member 1 while with insufficient bias the electric charge escapes from the member 1 to the roller 11, thereby causing fogging. Therefore whenever the environment where the electrophotosensitive member 1 is placed or the lot of the member 1 changes, the bias voltage should be adjusted. The table below shows the scope of optimal bias voltage for zinc oxide coated paper or the electrophotosensitive member 1 which are sampled from two lots A and B at different temperature and humidity conditions. When macroscopically measured, the electric potential on the surface ranges from −400 to −450 V in all cases. The table indicates that there is a wide fluctuation in the scope of optimal bias voltage depending on the environment or the lot.

| | 15° C., 20% | 24° C., 50% | 35° C., 85% |
|---|---|---|---|
| Lot A | −1000 V or below | −600 to −900 V | −450 to −600 V |
| Lot B | −900 V or below | −600 to −900 V | −400 to −500 V. |

As shown in this embodiment, the inventors conceived the idea of biasing the roller 11 through the shield case 2*a* of the charger 2. Subsequent experiments produced a satisfactory result. In other words, even if the environmental conditions or the lot changed, no adverse effect such as density variation or fogging occurred. This may be explained by the following reasons: the electric current pouring from the corona wires 2*e* can be considered to be substantially constant. Electric current leaks through the member 1 to the opposing electrode 2*f*. The leaked current fluctuates depending on the condition of the member 1; for example, when the member 1 is high in humidity so as to contain more water, the current increases, when the member 1 is low in humidity so as to contain less water, the current decreases. The electric current which flows from the portion 2*b* of the shield case 2*a* to be grounded via the resistor 16 is therefore stronger in the former case and weaker in the latter case. The bias voltage of the roller 11 changes correspondingly to adjust automatically within the optimal range. Such an automatic adjusting mechanism has been verified in experiments.

According to this invention, a portion 2*b* of the shield case 2*a* and the roller 11 are electrically connected and are grounded via the resistor 16 in order to adjust the electric voltage to be applied on the roller 11 to optimal under a wider scope of environmental conditions by means of the electric current which flows to the opposing electrode 2*f* via the member 1 having variable resistance depending on environmental conditions, the electric current which flows from a portion 2*d* of the shield case 2*a* to ground the electric current which flows via the resistance 16. Particularly when the humidity is extremely low, as electric current seldom leaks from the member 1, the voltage applied on the roller 11 becomes excessively high. The resistor 16 is provided to suppress such excessively high voltage by leaking grounded electric current via the resistance 16. However, under normal conditions, grounding via the resistance 16 is not necessarily required.

The reason that the shield case is divided into two in structure according to this invention is because the portion 2*d* thereof should be given the function as the shield case per se. More specifically, a shield case 2*a* is generally provided for grounding in order to avoid fluctuation in the electric charge which otherwise is caused to charge on the electrophotosensitive surface 1*a*. The shield case 2*a* is used herein to ground the portion 2*d*. As the portion closer to the electrophotosensitive surface 1*a* is more effective in the removal of the charging fluctuation by means of the shield case 2*a*, the portion 2*b* which is farthermost from the electrophotosensitive surface 1*a* is used for bias voltage application in this invention. The resistance 16 is preferably in the range from 10MΩ to 10 GΩ.

The structure according to this invention is capable of developing surfaces free of density variation or fogging by means of a developing device 4 in the one-component magnetic brush process even though the rollers 11, 12 are stained. Such a remarkable effect was proven in an experiment wherein, even though the rollers 11, 12 are deliberately soiled with substances which are possibly present in electrophotographic devices, beautifully developed surfaces were obtained.

In the first embodiment shown in FIG. 3, a portion 2*b* of the shield case 2*a* is directly connected to a roller 11 and simultaneously grounded via the resistance 16. As mentioned above, in such a case, the bias voltage applied on the roller 11 is suppressed or restricted to a maximum. The bias voltage applied on the roller 11 may be adjusted to optimal even when the resistance on the member 1 varies by properly selecting the area of the portion 2*b* of the shield case 2*a* or the distance between the portion 2*b* and the corona wires 2*e*.

Figure 4:
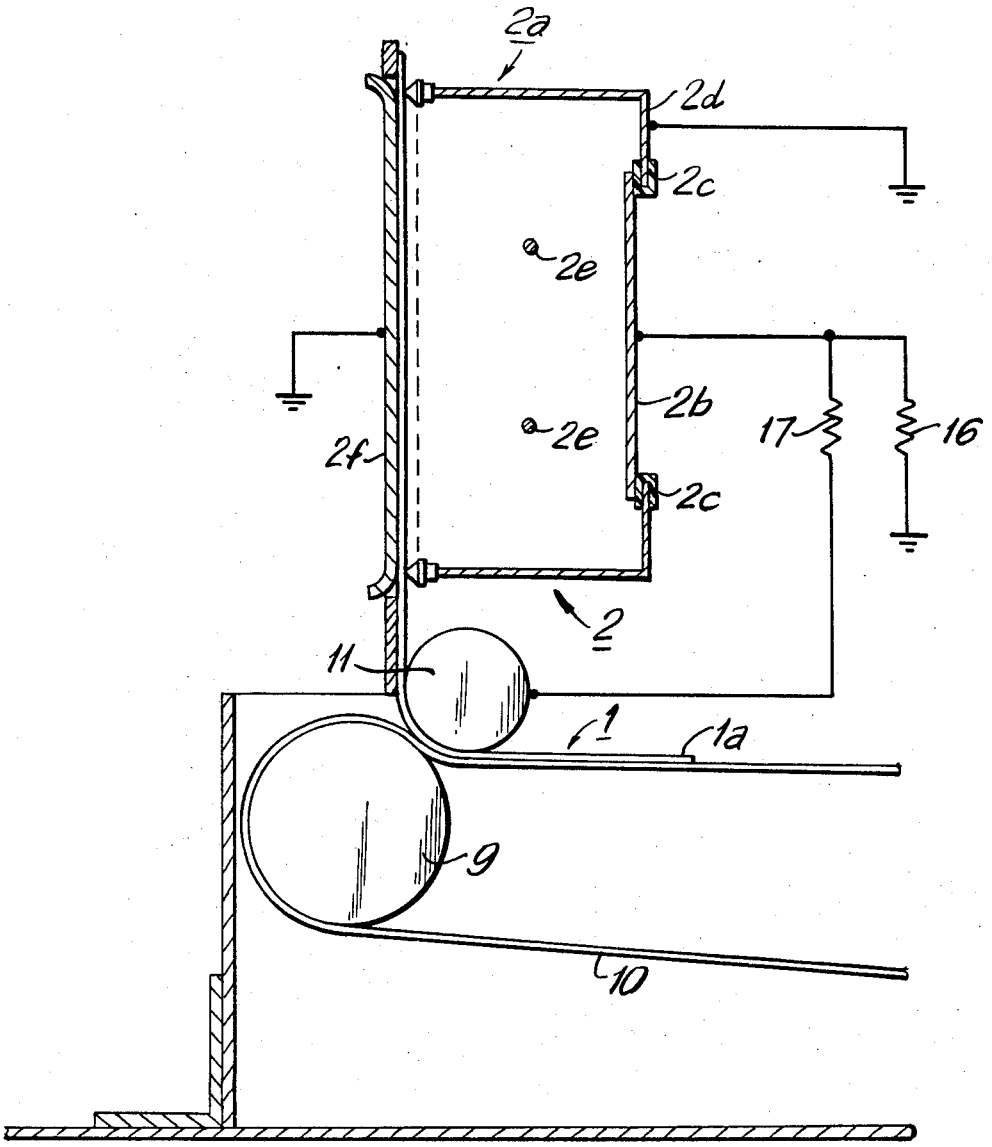
FIG. 4 is a vertical cross section to show the main parts of a second embodiment of this invention.
Figure 5:
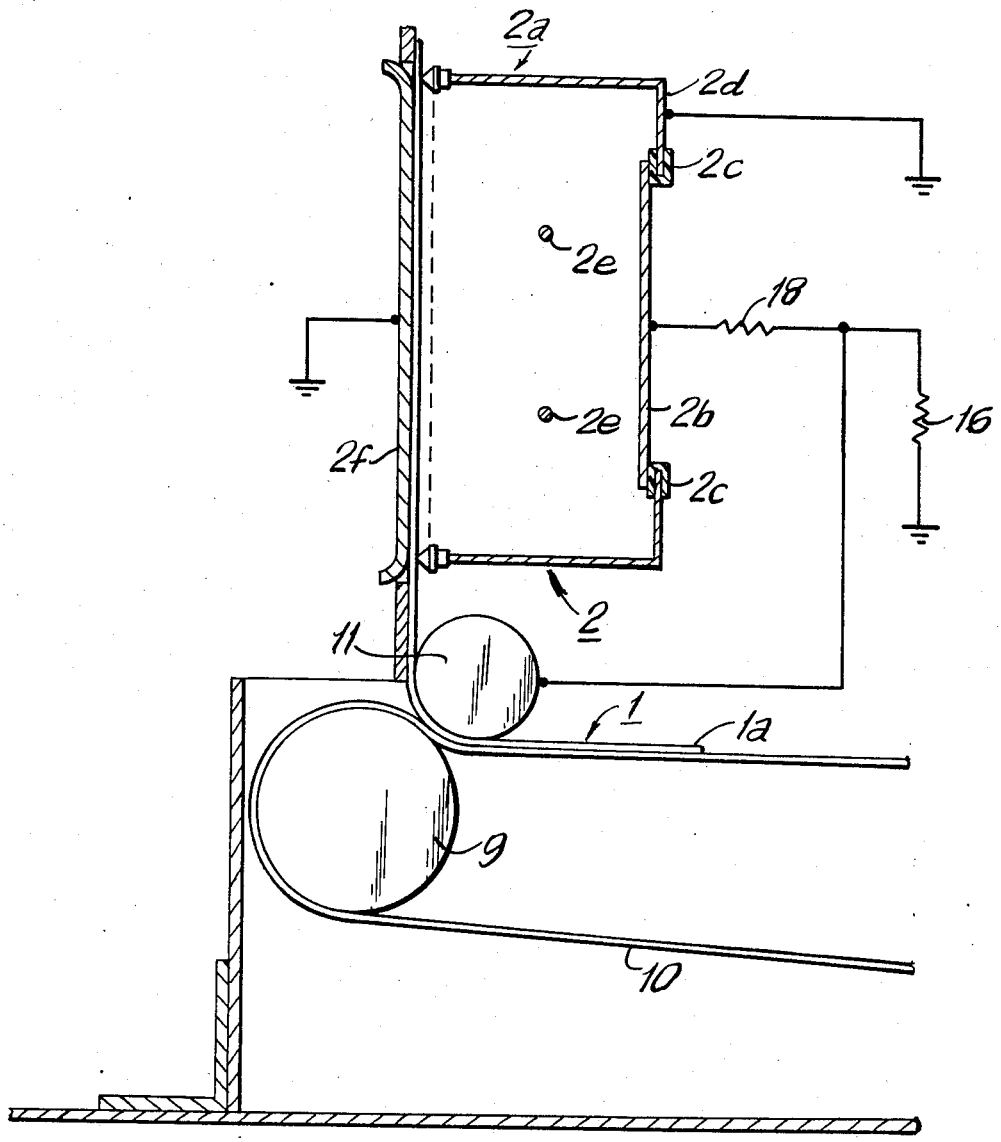
FIG. 5 is a vertical cross section to show the main parts of a third embodiment of this invention.
Figure 6:
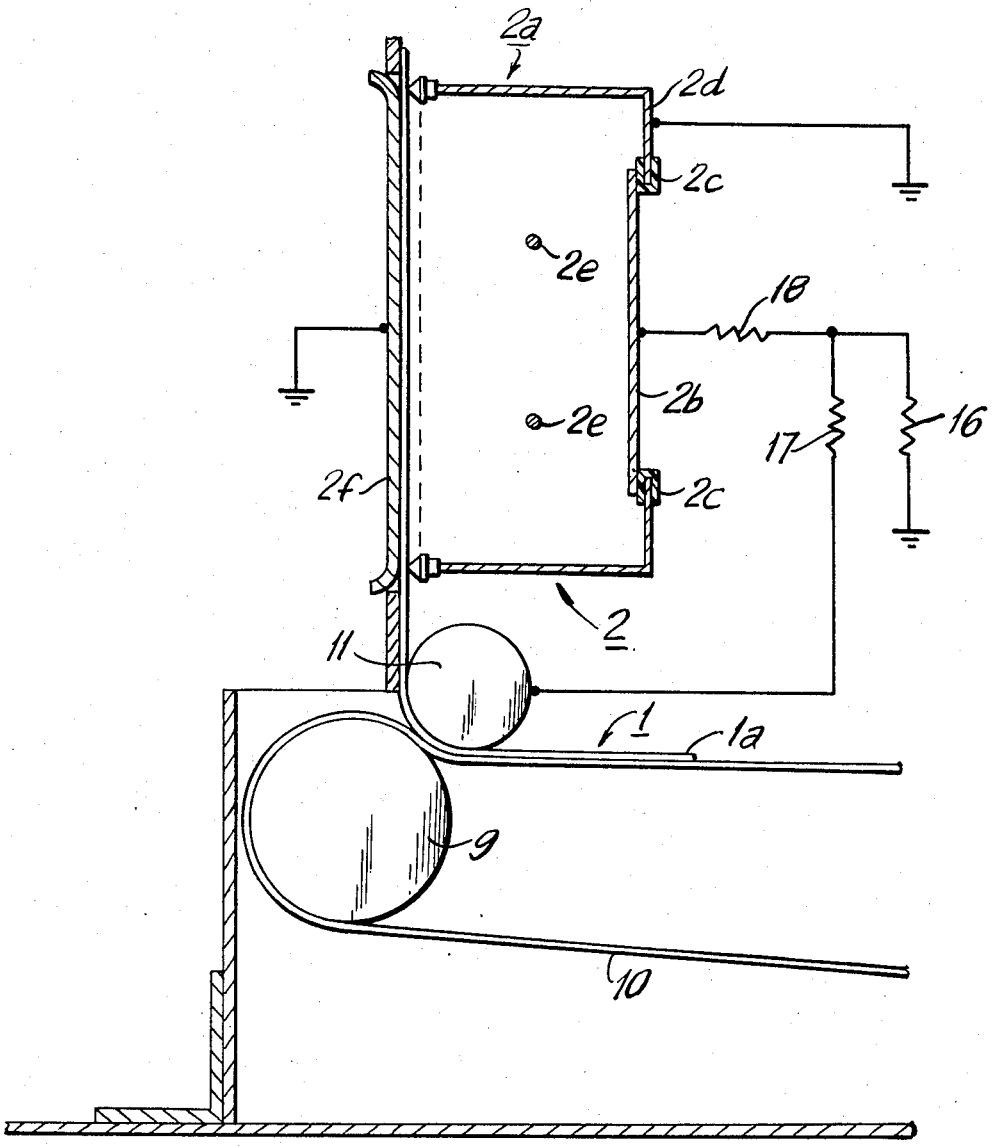
FIG. 6 is a vertical cross section to show the main parts of a fourth embodiment of this invention.

As shown in FIGS. 4 to 6, a similar effect may be achieved by connecting a resistance between the portion 2*b* of the shield case 2*a* and the roller 11.

In the second embodiment shown in FIG. 4, the portion 2*b* of the shield case 2*a* is grounded via the first resistance 16 and at the same time the portion 2*b* and the roller 11 are connected via second resistance 17 which is provided at a location between the case 2*a* and the resistance but closer to the case 2*a* than to the resistance 16.

In the third embodiment shown in FIG. 5, a portion 2*b* of the shield case 2*a* is grounded via the first resistance 16 and a third resistance 18 which are serially connected and the roller 11 is connected between the resistances 16 and 18.

In the fourth embodiment shown in FIG. 6, the portion 2*b* of the shield case 2*a* is grounded via the first and the third resistances 16 and 18 which are serially connected and at the same time the roller 11 is connected between the first and the third resistances 16 and 18 via the second resistance 17.

As described in the foregoing statement referring to preferred embodiments, according to this invention, critical factors which would otherwise disturb the electric potential patterns on the electrophotosensitive surface in a one-component magnetic brush development process can be removed by automatically adjusting the bias voltage applied on rollers to be optimal, and density fluctuation in positive images or fogging in reversed images can be avoided to achieve aesthetically satisfactory surfaces. The above effect achieved by this invention is even more remarkable on reversed images because a fogged surface or a blackened surface will show a worse impression than one with a density variation.

We claim:

1. An electrophotographic system comprising: corona wires covered by a shield case, charging means for charging an electrophotosensitive surface of an electrophotographic member by applying high voltage on said corona wires, exposure means for projecting picture image information on the electrophotosensitive surface of the electrophotographic member after having been charged by said charging means to form electrostatic latent images thereon, development means for developing the electrostatic latent images formed by said exposure means on the electrophotosensitive surface by a magnetic brush process, a conveying mechanism for carrying the electrophotographic member through the charging means, the exposure means and the development means consecutively, a conveyor roller made of conductive material which abuts on said electrophotosensitive surface of the electrophotographic member after the charging means but before the development means and which is electrically insulated from other components, said shield case having at least one portion which is insulated from another portion thereof and is electrically connected with said roller so as to apply a bias voltage thereon.

2. An electrophotographic system as claimed in claim 1, comprising cutter means for severing a roll of electrophotographic member by a predetermined length, the electrophotographic member comprising a photoconductor on a substrate.

3. An electrophotographic system as claimed in claim 1, wherein said development means comprises a one-component magnetic brush development device.

4. An electrophotographic system as claimed in claim 1, wherein said development means comprises a permanent magnet and a sleeve, and structured so that a bias voltage of the same polarity as the one charged on the electrophotosensitive surface of the electrophotographic member is applied on said sleeve for reversed image development, while an electric potential substantially the same as the potential of a non-image area of the electrophotographic member after exposure is applied to said sleeve.

5. An electrophotographic system as claimed in claim 1, wheren said one portion of the shield case is directly connected with the roller, and said one portion and the roller are grounded via a resistance.

6. An electrophotographic system comprising: corona wires covered by a shield case, charging means for charging an electrophotosensitive surface of an electrophotographic member by applying high voltage on said corona wires, exposure means for projecting picture image information on the electrophotosensitive surface of the electrophotographic member after having been charged by said charging means to form electrostatic latent images thereon, development means for developing the electrostatic latent images formed by said exposure means on the electrophotosensitive surface by a magnetic brush process, a conveying mechanism for carrying the electrophotographic member through the charging means, the exposure means and the development means consecutively, a conveyor roller made of conductive material which abuts on said electrophotosensitive surface of the electrophotographic member after the charging means but before the development means and which is electrically insulated from other components, said shield case having at least one portion which is insulated from another portion thereof and is electrically connected with said roller so as to apply a bias voltage thereon, said one portion of the shield case being grounded via a first resistance, and said one portion and the roller being connected via a second resistance connected between the shield case and the first resistance but closer to the shield case than the first resistance.

7. An electrophotographic system comprising: corona wires covered by a shield case, charging means for charging an electrophotosensitive surface of an electrophotographic member by applying high voltage on said corona wires, exposure means for projecting picture image information on the electrophotosensitive surface of the electrophotographic member after having been charged by said charging means to form electrostatic latent images thereon, development means for developing the electrostatic latent images formed by said exposure means on the electrophotosensitive surface by a magnetic brush process, a conveying mechanism for carrying the electrophotographic member through the charging means, the exposure means and the development means consequently, a conveyor roller made of a conductive material which abuts on said electrophotosensitive surface of the electrophotographic member after the charging means but before the development means and which is electrically insulated from other components, said shield case having at least one portion which is insulated from another portion thereof and is electrically connected with said roller so as to apply a bias voltage thereon, said one portion of the shield case being grounded via first and second resistances which are serially connected, and the roller being connected between the first and the second resistances.

8. The electrophotographic system as claimed in claim 7, wherein the roller is connected between the first and the second resistances via a third resistance.

* * * * *